US007703247B2

(12) United States Patent
Surowiecki et al.

(10) Patent No.: US 7,703,247 B2
(45) Date of Patent: Apr. 27, 2010

(54) SHEET METAL CORNER STUDS

(76) Inventors: Matt F. Surowiecki, 10023 Martin Luther King, Jr. Way S., Seattle, WA (US) 98178; Tadeusz (Ted) Wrobel, 38127 S. 38th Ave., Auburn, WA (US) 98001

( * ) Notice: Subject to any disclaimer, the term of this patent is extended or adjusted under 35 U.S.C. 154(b) by 620 days.

(21) Appl. No.: 11/724,943

(22) Filed: Mar. 16, 2007

(65) Prior Publication Data

US 2008/0236071 A1 Oct. 2, 2008

(51) Int. Cl.
*E04B 1/00* (2006.01)

(52) U.S. Cl. ..... 52/276; 52/241; 52/481.1; 52/846

(58) Field of Classification Search ..... 52/276, 52/241, 275, 280, 281, 481.1, 481.2, 836, 52/846, 287.1, 282.4, 658, 588.1, 282.1; 29/897.33, 897.35; D25/126
See application file for complete search history.

(56) References Cited

U.S. PATENT DOCUMENTS 3,845,601 A * 11/1974 Kostecky ..... 52/290
4,222,211 A * 9/1980 Pearson ..... 52/745.12
4,351,244 A * 9/1982 Suttles ..... 108/107
7,127,862 B2 * 10/2006 Saldana ..... 52/715

* cited by examiner

*Primary Examiner*—David Dunn
*Assistant Examiner*—Adam Barlow
(74) *Attorney, Agent, or Firm*—Bruce A. Kaser

(57) ABSTRACT

Corner studs (10, 10') have webs that are folded into two parts (16, 18) separated by an angle of between about 150° and 270°. These studs are used at corners formed where two framing walls meet. The first wall has upper and lower channel members with continuous flanges. The second wall has upper and lower channel members with squared ends that abut continuous flanges of upper and lower channels of the first framing wall. Studs (10, 10') are provided which webs that include flange-receiving slots (12, 28) that extend from the ends of the studs (10, 10') longitudinally inwardly along a bend line (14) between the two web parts (16, 18). The flanges (36, 52) are received within these slots (12, 28) so that a first portion of the studs (10, 10') can be installed into the channel space of the first channel member and the remaining portion of the studs (10, 10') can be installed into the channel space of the channel members of the second wall.

10 Claims, 10 Drawing Sheets

SHEET METAL CORNER STUDS

TECHNICAL FIELD

This invention relates to sheet metal framing walls. More particularly, it relates to the provision of studs for use where two framing walls intersect, for facilitating the connection of the two walls while reducing both material and labor.

BACKGROUND OF THE INVENTION

Building walls intersect each other at corners and at locations between the corners. U.S. Pat. No. 4,689,930 granted Sep. 1, 1987 to Robert J. Menchetti, discloses is a corner stud to which two standards studs are connected. U.S. Pat. No. 3,363,377, granted Jan. 16, 1968, to Melvin H. Beckman, and U.S. Pat. No. 4,283,892, granted Aug. 18, 1981 to Larry B. Brown, each disclose studs constructed to be usable at an intersection of a first wall with a second wall between corners. There is a need for intersection studs for use at intersections between corners and a utilization of such studs that facilitates construction of the walls while reducing both material and labor. It is the primary object of the present invention to fill this need.

Framing walls are formed from upper and lower horizontal channel members, sometimes referred to as "tracks", and vertical studs extending between the channel members. The opposite ends of the studs fit within channel spaces provided by the channel members and the studs are connected to the side flanges of the channel members by mean of screws. For economical reasons, it is desirable to install the channel members for a wall without having to cut out portions of the flanges at the intersection of the wall by a perpendicular wall. It is desirable to be able to abut the square cut end of the channel of the perpendicular wall against the flange of the first wall. The problem with this arrangement is that the flange of the channel member of the first wall that span across the end of the channel member of the second wall, prevents the placement of the ends of the corner studs in both of the channel spaces where they meet at the intersection. It is an object of the present invention to provide a stud that is constructed to allow a first portion of its end to be positioned in the channel space of one side of the flange and the remaining portion of the end of the stud to be positioned in the channel space on the opposite side of the flange.

BRIEF SUMMARY OF THE INVENTION

It is an object of the present invention to provide a framing wall with a first channel member having a web and spaced apart first and second flanges projecting from the web and together with the web forming a first channel space. An adjoining second channel member has a web and spaced apart first and second flanges projecting from said web and together with the web forming a second channel space. The second channel member extends perpendicular to the first channel member and has a square cut end that substantially abuts the first flange of the first channel member. An elongated stud is provided that has a web and first and second flanges connected to the web. The web is bent along a longitudinal bend line to form first and second web parts which are substantially perpendicular to each other. A first flange extends perpendicularly from the first part of the web and the second flange extends perpendicularly from the second part of the web. The stud has an end and a longitudinal slot extending inwardly from the end along the bend line. When the stud is installed, the first flange of the first channel member is positioned in the longitudinal slot. The first web part and the first flange of the stud are positioned in the first channel space. The second web part and the second flange of the stud are positioned in the second channel space. The first web part of the stud is inwardly continuous the first flange of the first channel member. The second web part of the stud is inwardly continuous the first flange of the second channel member.

Objects, advantages and features of the invention will become apparent from the description set forth below, from the drawings, and from the principles that are embodied in the specific structures that are illustrated and described.

BRIEF DESCRIPTION OF THE SEVERAL VIEWS OF THE DRAWINGS

Like reference numerals refer to like parts throughout the several views of the drawing, and.

DETAILED DESCRIPTION OF THE ILLUSTRATED EMBODIMENT

Figure 1:
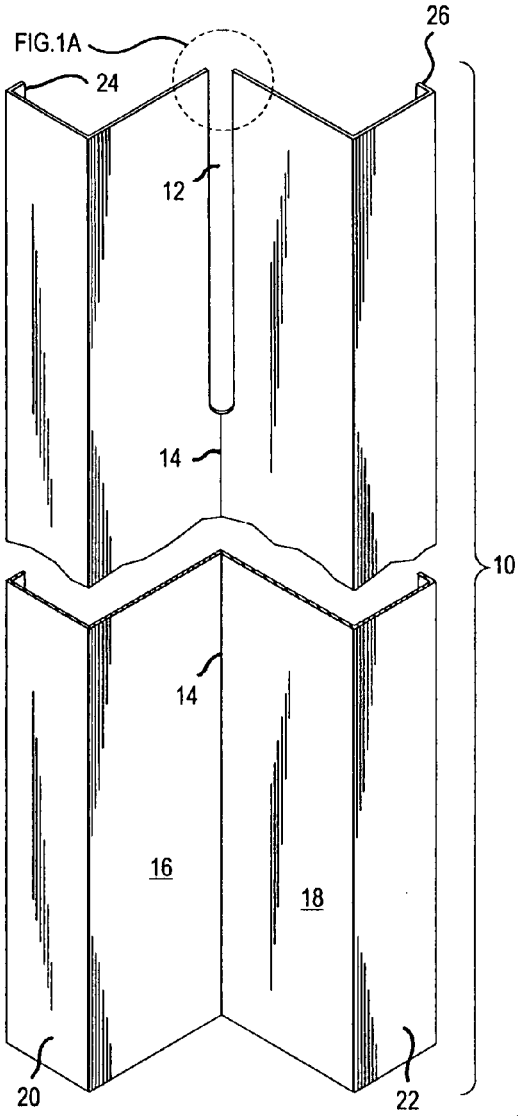
FIG. 1 is a pictorial view of a corner stud constructed according to the present invention, such view being broken in the middle to show indeterminate length.

FIG. 1 shows a stud 10 incorporating an aspect of the present invention. The stud 10 is preferably formed from a single, continuous strip of sheet metal. It is first roll formed to form a standard stud shape composed of a planar web 16, 18, flanges 20, 22 that project from the outer edges of the web 20, 22, perpendicular to the web parts 20, 22, and lips 24, 26 which project inwardly from the outer edges of the flanges, in co-planar parallelism with each other, and perpendicular to the web parts 16, 18. After the stud 10 is formed into this basic shape, the web 16, 18 is bent about a longitudinal bend line 14, to create the two web parts 16, 18. In FIGS. 1-10, the web parts 16, 18 extend substantially perpendicular to each other. The flanges 16, 18 extend substantially perpendicular to the web parts 12, 14. The lips 20, 22 (if used) extend substantially perpendicular to the flanges 16, 18. Stud 10 includes a fold line slot 12 in the upper end portion of the stud 10 extending longitudinally inwardly from the upper end of the stud 10 along a fold line 14.

In preferred form, a second fold line slot 28 (FIG. 2) is provided at the lower end of the stud 10'. These slots 12, 28 are blind slots that extend from the ends of the stud 10', inwardly along the fold line 14.

Figure 5:
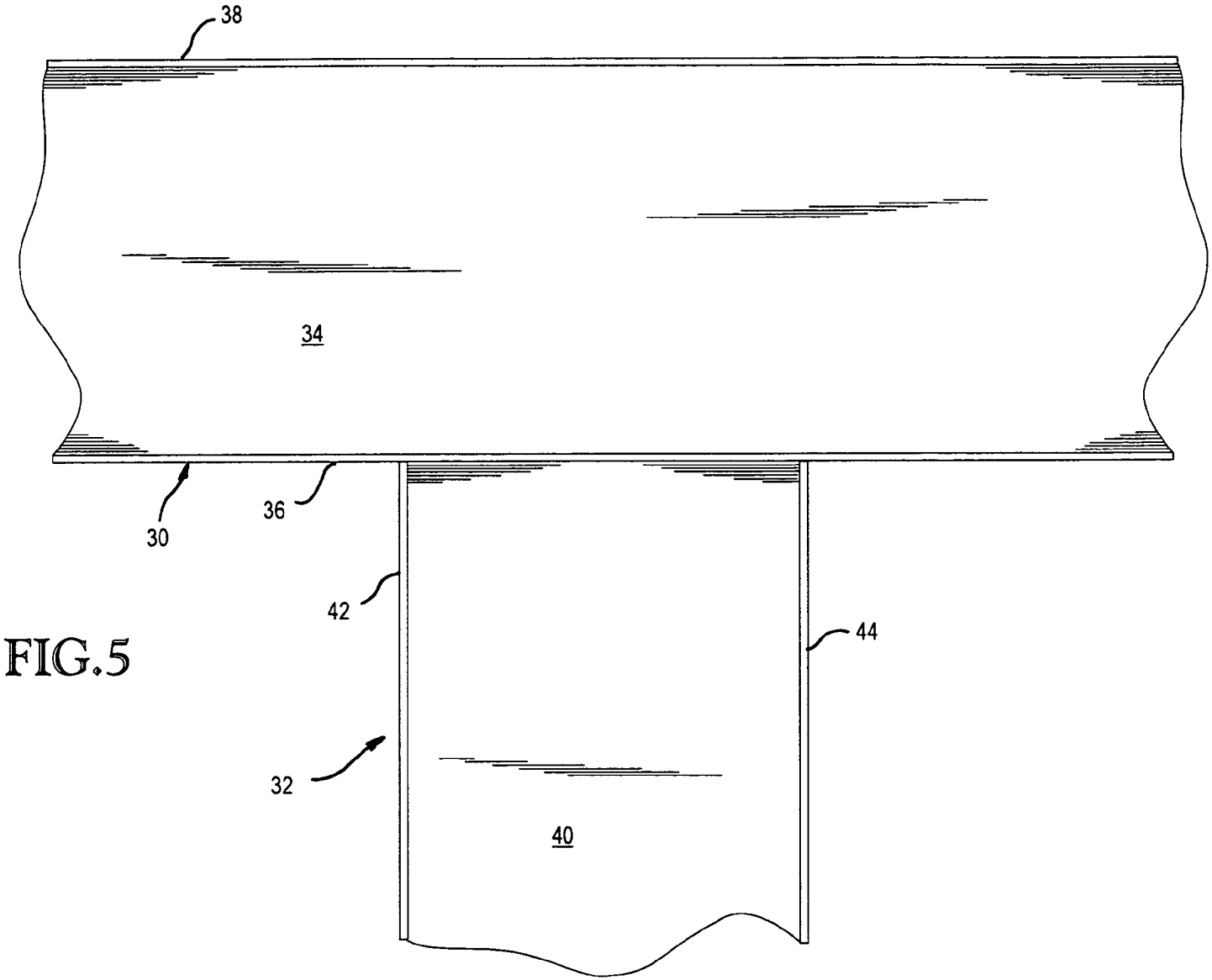
FIG. 5 is a fragmentary plan view of a first channel shaped track on the left and a second channel shaped track on the right, said second track extending perpendicular to the first track and having a squared end that substantially abuts a side flange of the first track.
Figure 7:
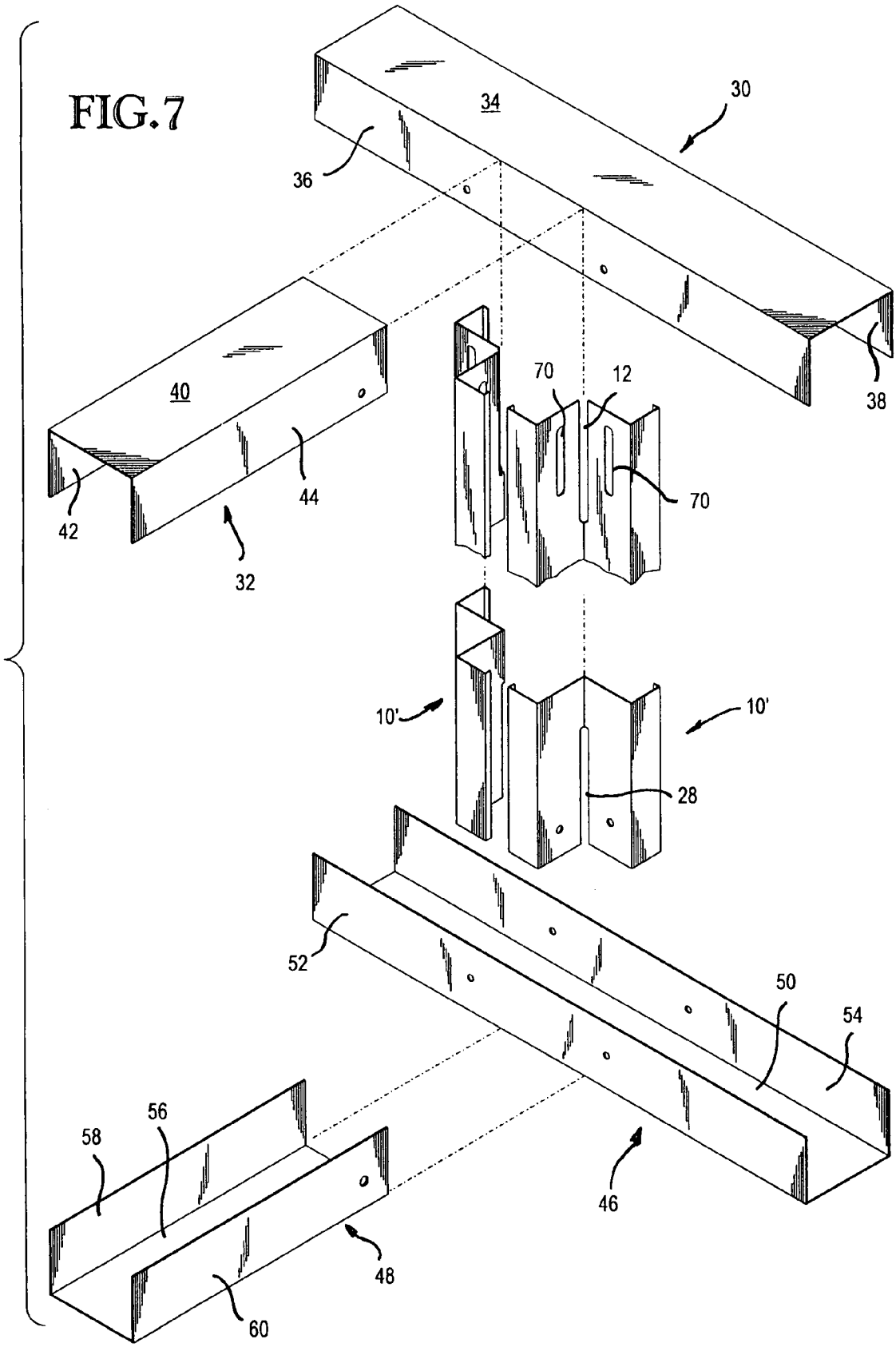
FIG. 7 is an exploded pictorial view of a pair of perpendicular upper and lower tracks and a pair of corner studs.
Figure 8:
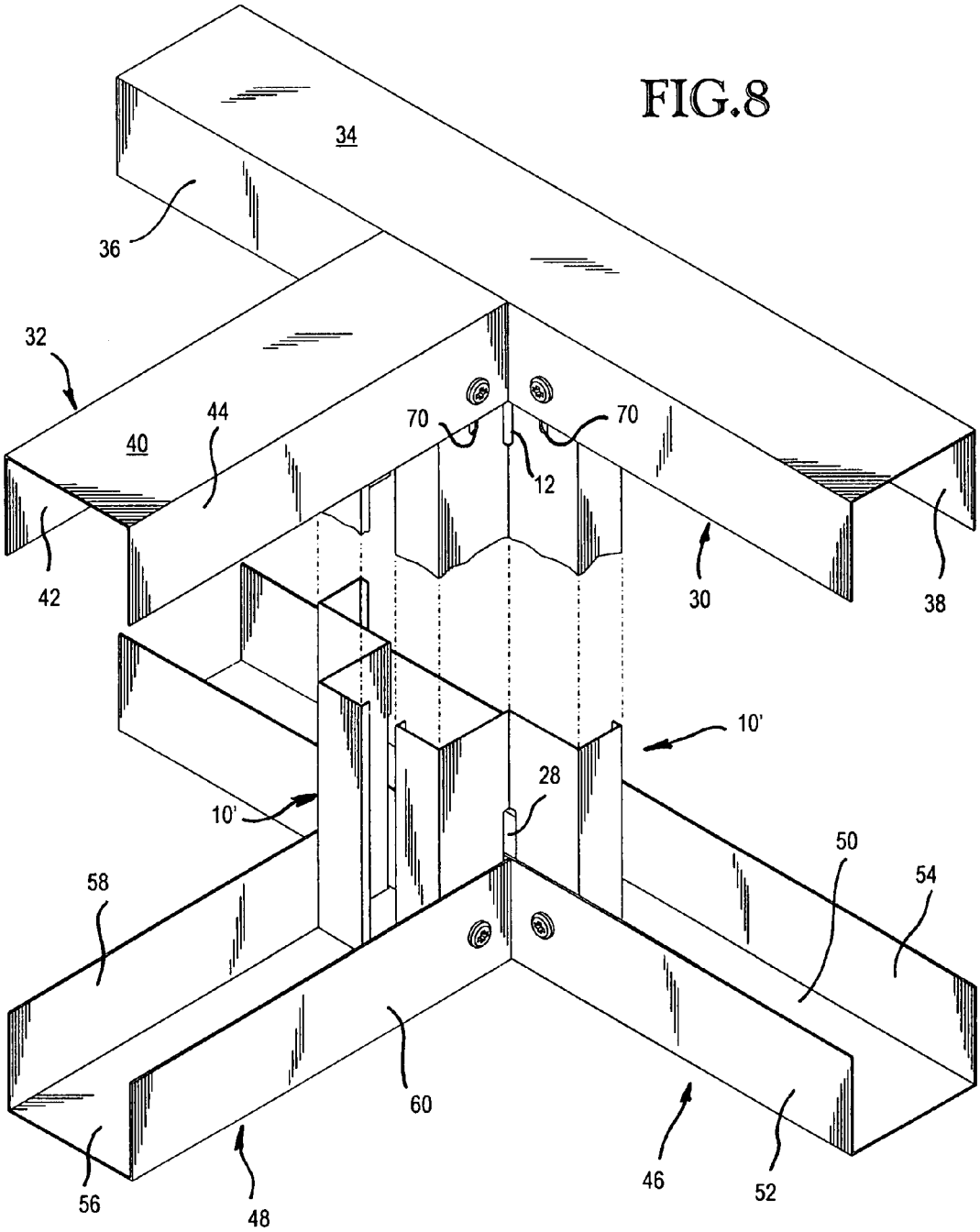
FIG. 8 is an assembled view of the components shown by FIG. 7.
Figure 9:
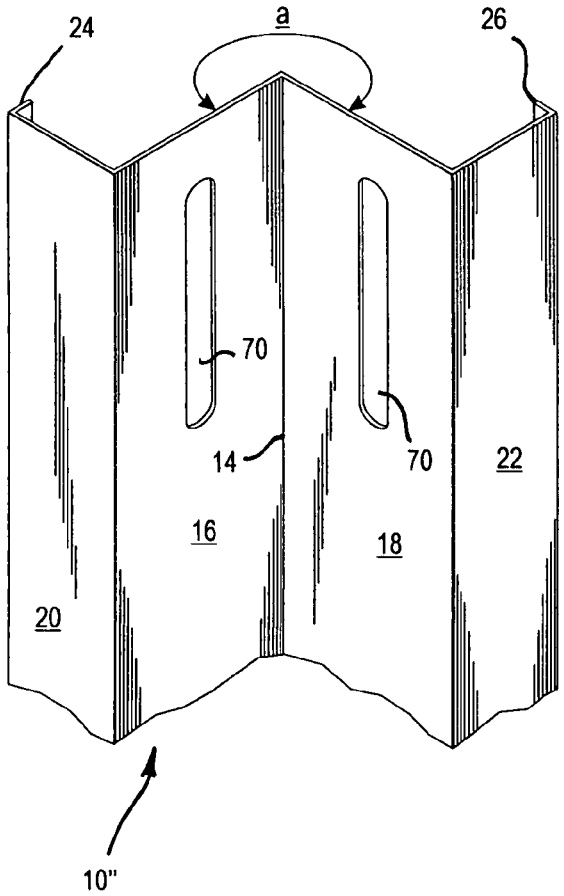
FIG. 9 is a fragmentary upper end view of a stud having screw receiving deflection slots in the web parts but no flange-receiving slot at the fold line.
Figure 10:
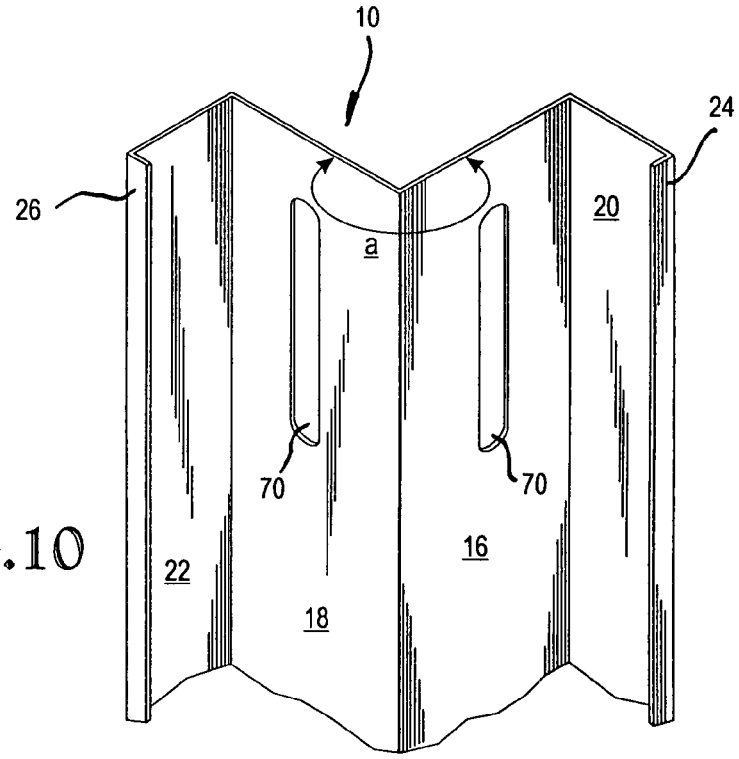
FIG. 10 is a view like FIG. 9, but looking towards the opposite side of the stud.
Figure 11:
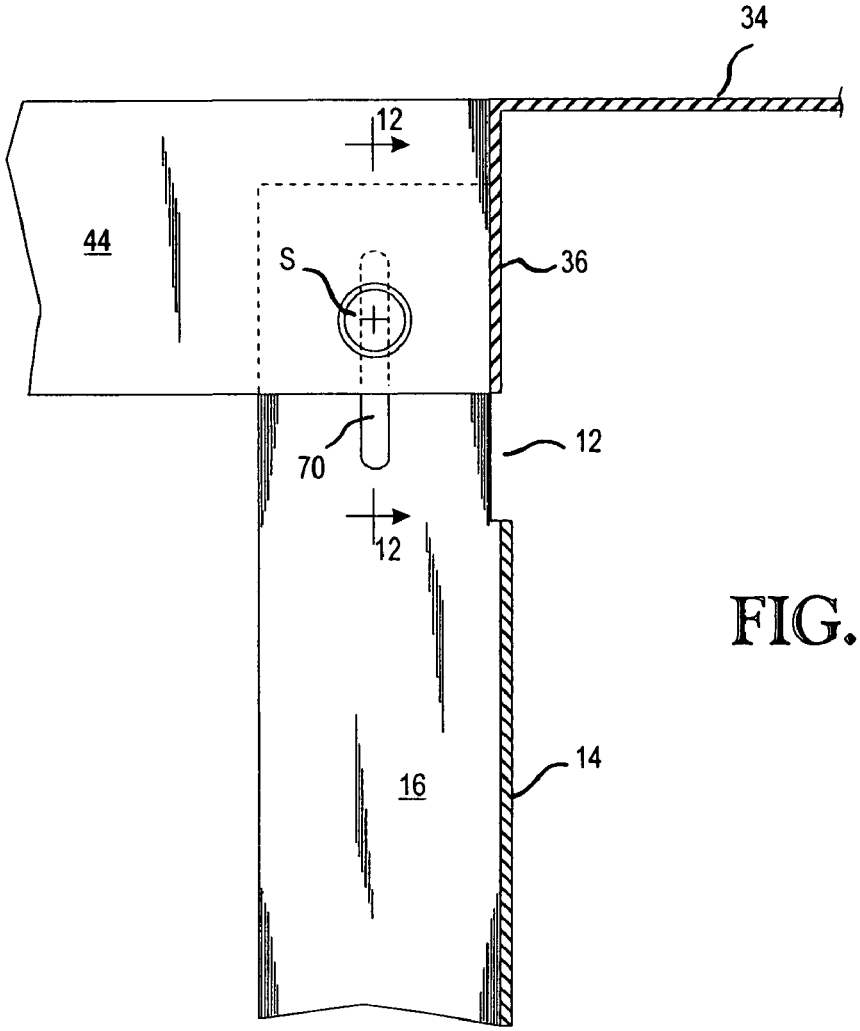
FIG. 11 is a sectional view taken substantially along line 11-11 of FIG. 8.
Figure 12:
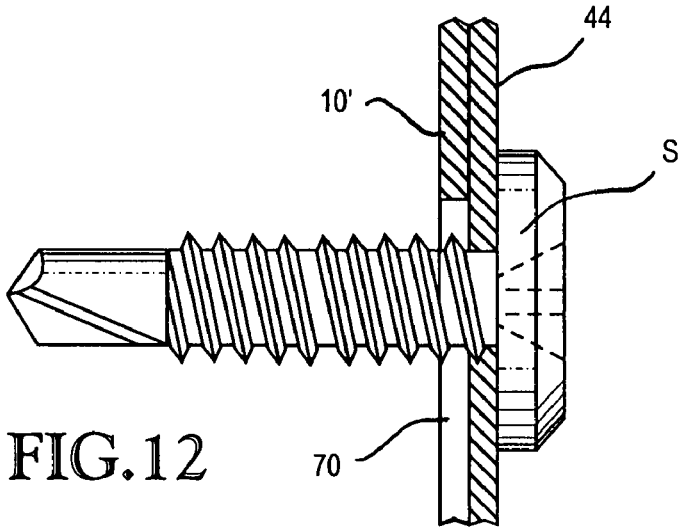
FIG. 12 is a view taken substantially alone line 12-12 of FIG. 11.

FIG. 5 shows a first track or channel member 30 and a second track or channel member 32. In FIGS. 7 and 8, the channel members 30, 32 are upper tracks. Channel member 30 may be a part of an outside wall of a building, for example. Channel member 32 may be an intersecting inside wall of the building. Channel member 30 comprises a web 34, a first flange 36 and a second flange 38. Channel member 32 has a web 40, a first flange 42 and a second flange 44. Channel 32 has a squared end that abuts, or is positioned close to, the first flange 36 of channel member 30. This is a preferred construction of the intersection between two perpendicular channel members 30, 32. However, it creates a problem in that the portion of flange 36 that extends across the end of channel 32 prevents corner studs from being placed in the two channel members 30, 32. One way of solving this problem is to take a pair of metal shears and cut away the flange 36 where it extends across the end of channel member 32. A purpose of this invention is to make it possible to avoid the labor costs and flange weakening that is associated with cutting an opening in the flange 36 at the location of an intersecting channel member 32.

Figure 1A:
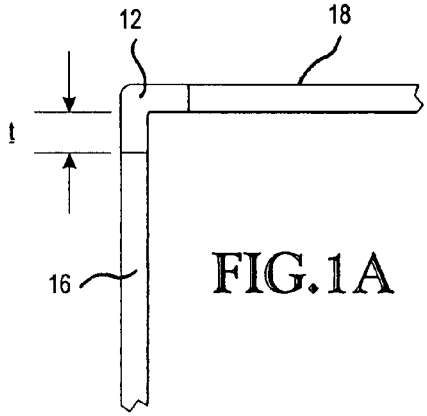
FIG. 1A is a fragmentary end view taken in the region of the circle marked FIG. 1A in FIG. 1.
Figure 2:
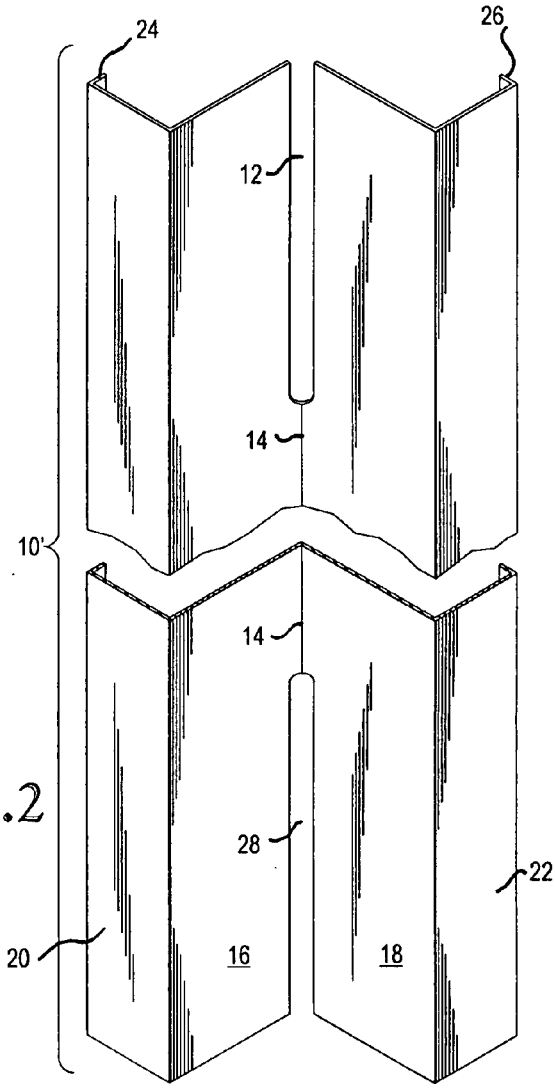
FIG. 2 is a view like FIG. 1, but showing a channel flange receiving bend line slot at both the top and bottom ends of the stud.
Figure 3:
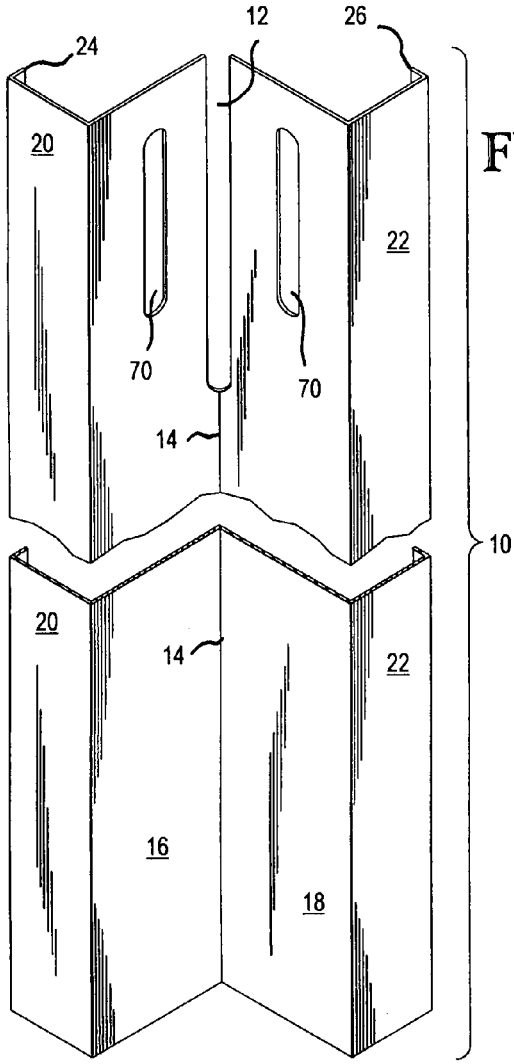
FIG. 3 is a view like FIG. 1 showing screw-receiving deflection slots in the two parts of the stud web.
Figure 4:
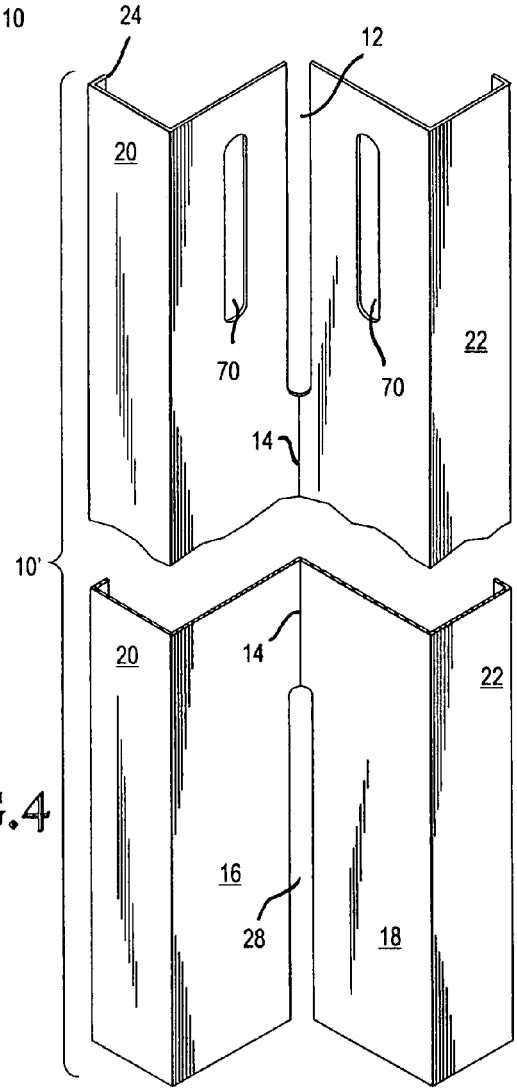
FIG. 4 is a view like FIG. 2 showing screw-receiving deflection slots in the web parts at the upper end of the stud.

According to an aspect of the invention, a flange-receiving slot 12 is formed in the end portion of the stud 10 substantially along the fold line 24. As shown by FIG. 1A, the slot 12 has a dimension t which is slightly wider than the thickness dimension of the flange 36. When the stud 10 is installed, the flange 36 is positioned within the slot 12 in the manner shown by FIGS. 6 and 6A.

Figures 6, 6A:
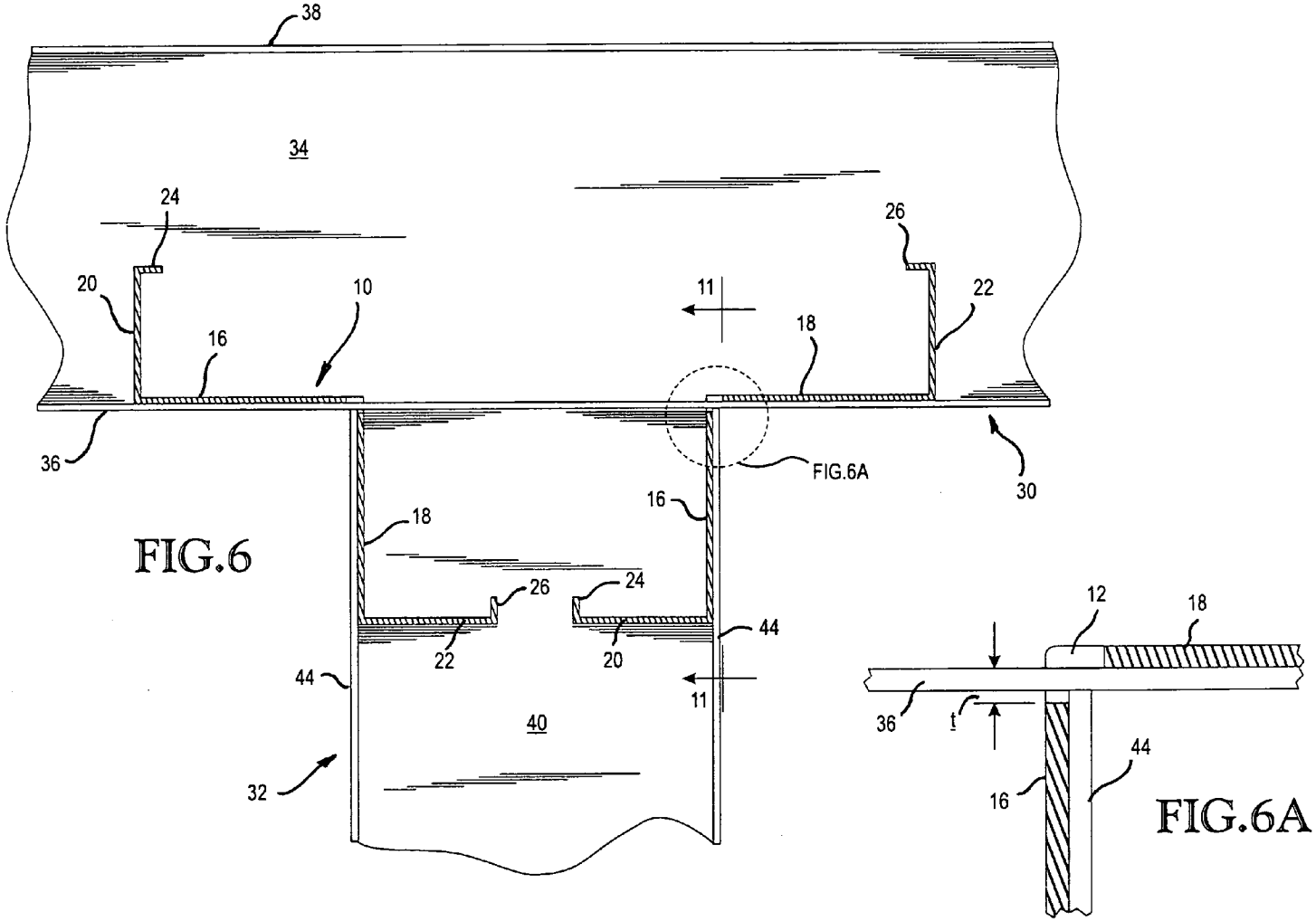
FIG. 6 is a view like FIG. 5, but showing cross sectional views of a pair of corner studs positioned inside the first and second tracks, such view showing a side flange of the track positioned in flange slots formed in end portions of the studs.
FIG. 6A is an enlarged scale fragmentary view taken in the region of the circle marked FIG. 6A in FIG. 6.

As shown by FIGS. 7 and 8, the upper channel member 30 confronts a lower channel member 46 and the upper channel 32 confronts a lower channel member 48. Channel member 46 includes a web 50 and flanges 52, 54 which extend upwardly substantially perpendicular to the web 50. The channel member 48 includes a web 56 and a pair of flanges 58, 60 which extend upwardly from the web 56 in parallel to each other and substantially perpendicular to the web 56. When the studs 10' are installed, the upper flange 36 is positioned in the upper slots 12 and the lower flange 52 is positioned in the lower slots 28. The slots 12, 28 are long enough to accommodate the height of the flanges 36, 52. As best shown by FIGS. 6 and 8, when the studs 10' are installed, the upper ends of the web parts 14 and the flanges 18 and lips 22 are positioned in the first channel member 30 and the web parts 12 and the flanges 16 and the lips 20 are positioned in the second channel member 32. The lower ends of web parts 16, 18, flanges 20, 22 and lips 24, 26 are positioned in channel 46. The lower ends of web parts 18, 16, flanges 20, 22 and lips 24, 26 are positioned in channel 48. The lower ends of the stud components rest on the lower webs 50, 56 whereas the upper ends of these components are spaced below the upper webs 34, 40. This is particularly true when spaces are provided between the upper ends of the studs and the upper webs to accommodate vertical movement or deflection in response to earthquakes and other forces which want to make the upper channel members move relative to the studs and the lower channel members.

FIGS. 3, 4, and 7-16 show screw slots 70 formed in the web parts 12, 14. When the studs 10' are installed and the flanges 36, 52 are in the stud slots 12, 28, the studs 10' are locked against movement sideways in tracks 30, 36 and 32, 48. The wallboard may be screwed to the studs 10' and the flanges 58, 60 but not to the flanges 42, 44. U.S. Pat. No. 6,854,237, granted Feb. 15, 2005, to Matthew F. Surowiecki, Jr., discloses a framing wall construction that includes slotted studs. The upper ends of the studs are slotted and screws extend through the flanges of the upper channel members and into and through the slots of the studs. This construction permits relative vertical movement between the upper channel members and the remainder of the framing wall. The studs provided by the present invention are used at an intersection between the end of one framing wall and a side portion of a second framing wall. Studs of the type disclosed by U.S. Pat. No. 6,854,237 are preferably used in the span portions of the walls between the corners. The studs disclosed by U.S. Pat. No. 6,854,237 extend entirely across the channel space in the upper and lower channels. As a result, when screws are installed to the flanges of the upper channel members and such screws extend through the slots in the studs, the studs are only movable vertically relative to the upper channel members. They are prevented from movement across the width of the channel members by the fact that they occupy the entire width of this space. They are prevented from moving sideways in the channel members by the screw extending through the slot in the upper end of the studs and the screws extending through both the flanges of the lower channel members and the flanges of the studs at the lower end of the studs.

When the studs 10' are positioned with the channel flanges 36, 52 within the corner slots 12, 28, the studs 10' are locked against movement crosswise of the channel members 30, 46. When screws S are used to connect the lower flanges 58, 60 and 52, 54 to the lower ends of the studs 10', the studs 10' are locked against movement in all directions relative to the lower channel members 46, 48. However, at their upper ends, the studs are not restrained against such movement. They are free to move a little bit crosswise of channel member 32. However, when wallboard is installed and screws are used to connect the wallboard to the web parts 16, 18 of the studs 10', as well as to the flanges 36, 38, 42, 44, 52, 54, 58, 60 of the channel members 30, 32, 46, 48, the framing members are all held against movement relative to the other framing members and relative to the wallboard panels.

Figure 16:
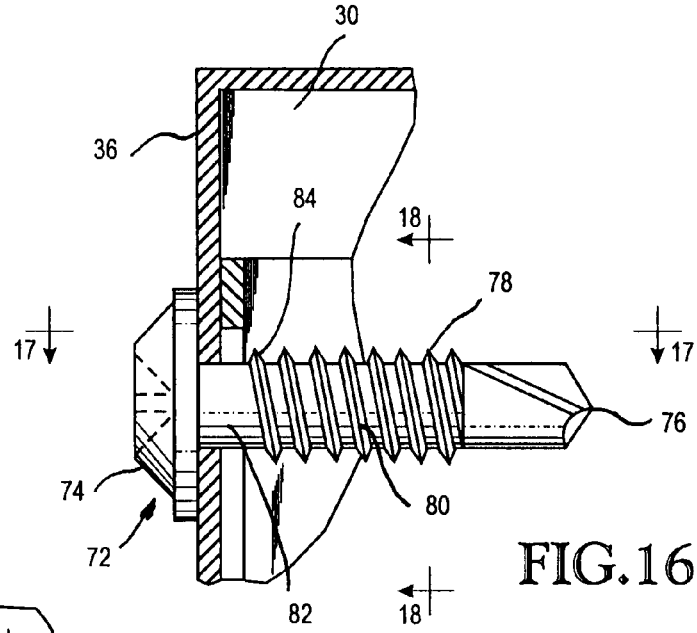
FIG. 16 is a vertical sectional view where a screw passes through the flange of the upper track and a slot in a web part of the stud.
Figure 17:
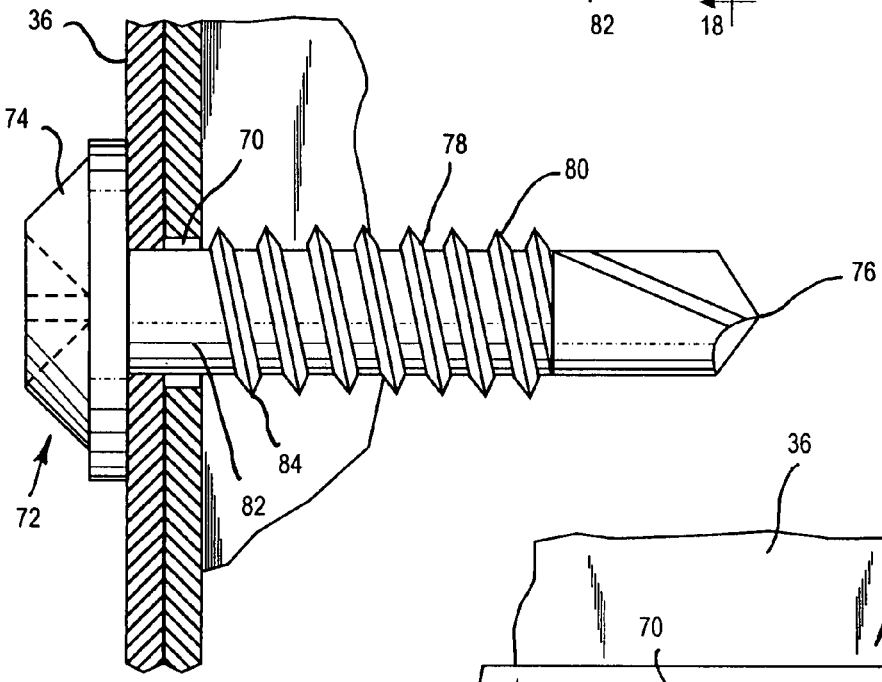
FIG. 17 is a sectional view taken substantially along line 17-17 of FIG. 16.
Figure 18:
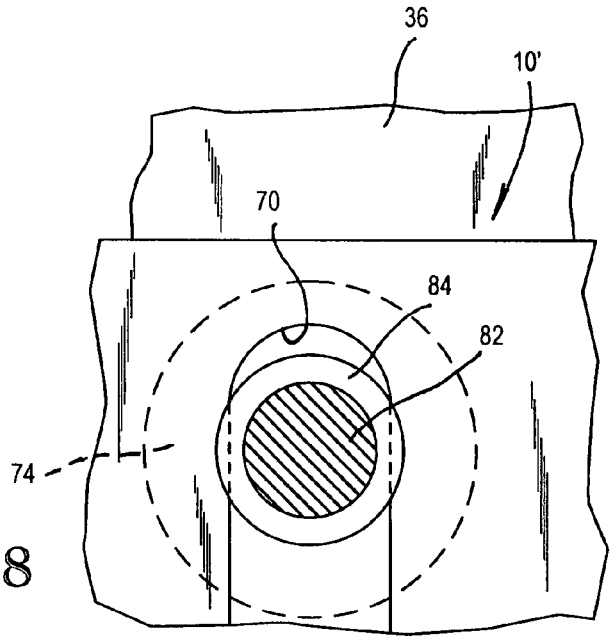
FIG. 18 is a sectional view taken substantially along line 18-18 of FIG. 16.

According to an aspect of the invention, deflection slots 70 may be sometimes added to the studs 10', so that relative movement in the vertical direction is provided between the studs and the upper channel members 30, 32. As previously stated, this does not present a problem with conventional slotted studs that are used in the span regions of the framing walls. Because these studs 11, 13 do not extend all the way across the channel spaces, they can move in a direction parallel to the flanges 36, 52. This movement will be prevented once the wallboard panels are installed. However, it must be prevented before and during attachment of the wallboard to the studs 10'. In the preferred embodiment, screws 72 of the type disclosed in and forming the subject matter of U.S. Pat. Ser. No. 10/694,563, filed Oct. 24, 2003 by Matthew F. Surowiecki, Jr., are used in the regions of the deflection slots 70. These screws 72 are shown in FIGS. 16-18 of the drawings. These screws 72 extend inwardly through the flanges 36, 42, 44 of the upper channel members 30, 32 and then extend into and through the slots 70. Each screw 72 has a head 74 at one end and a pointed opposite end 76. There is a shank portion between the head 74 and the pointed end 76. A portion of this shank, designated 78, includes helical threads 80. There is another portion of the shank, designated 82, that is between the head 74 and the end of thread 84 at the head end of the screw 72. When the screw 72 is installed, the unthreaded portion 82 is positioned within the slot 70. As shown by FIG. 18, shank portion 82 is narrower than the slot 70. End thread 84 of the threads 80 is positioned so that when the screw head 74 is against the flange, thread 84 is contiguous the metal on the two sides of the slot 70. FIG. 18 shows that the end thread 84 has a diameter that is larger than the slot 70 is wide. The axial distance between the inside surface of the head 74 and the closest portion of the end thread 84 is slightly longer than the combined thicknesses of the channel flange and the web part of the stud. As a result, there is no clamping of the sheet metal members between the screw head 74 and the end thread 84. Relative movement of the screw shank is permitted in the slot 70. If the upper channel member is forced downwardly relative to the stud 10', the screw shank portion 82 will move downwardly lengthwise of the slot 70. If the stud 10' wants to move upwardly relative to the upper channel member, the slot 70 will move relative to the shank portion 82. If a sideways force is applied against a wall, in one direction, the screw heads 74 will be forced against the channel flange. In the opposite direction, the end threads 84 will be moved against the portions of the stud walls that border the slot 70. In either event, the sideways forces are carried at the screw connections. Accordingly, this construction allows relative movement in the vertical direction, such as might occur during an earthquake or because of settling, and the walls are braced at least to some extent in the sidewalls direction. Thus, the studs 10' are held in place until the wallboard paneling is installed. Thereafter, this use of the fastener 72 makes the wall better able to resist wind loads and other types of side loads that they may encounter. Application Ser. No. 10/694,563 (Publication No. US2004-00083665-A1 is hereby incorporated herein by this specific reference.

Figure 14:
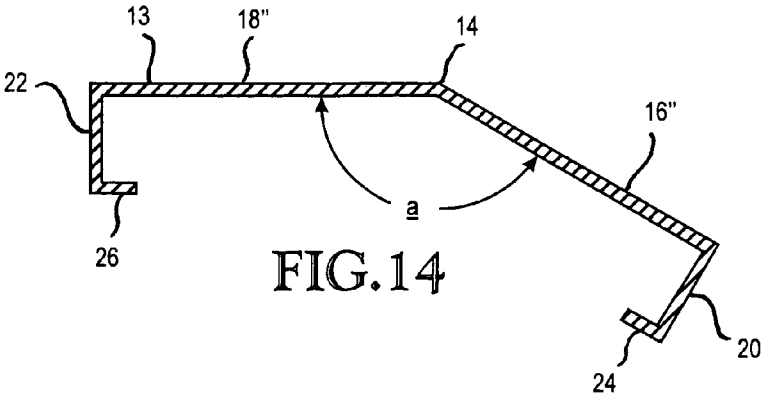
FIG. 14 is a view like FIG. 13, but showing the web parts separated by an angle of about 150° on the channel side of the stud.
Figure 13:
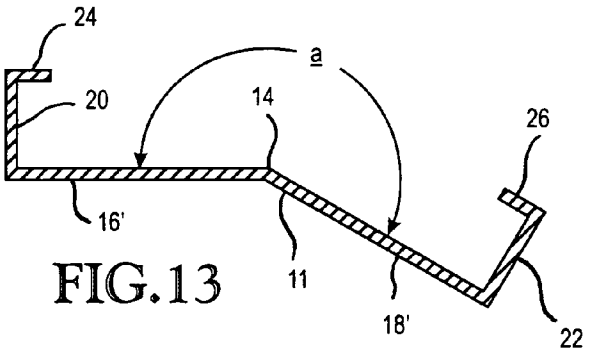
FIG. 13 is a cross sectional view of a stud having web side parts that are separated by an angle of substantially 210° on the channel side of the stud.
Figure 15:
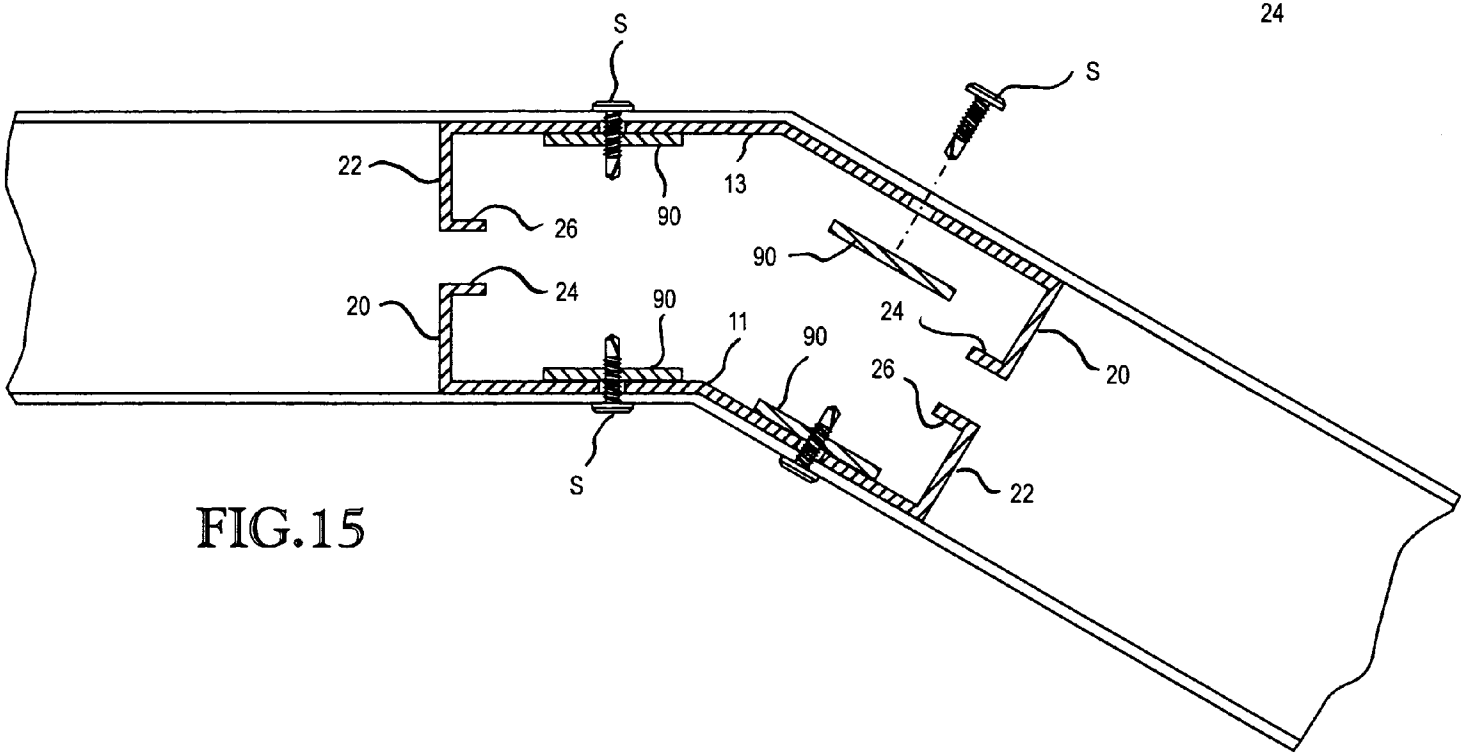
FIG. 15 is a view showing corner studs of a type shown by FIGS. 13 and 14 positioned inside of a track and showing screws extending through openings in the flanges of the track, through screw receiving deflection slot in the stud, and screwing into containment members positioned inwardly of the web parts of the stud.

According to an aspect of the invention, the corner studs of the invention may be used at corners where the walls extend diagonally to each other. The above-described studs 10, 10' have web parts 16, 18 that are substantially perpendicular to each other. As a result, the angle between the web parts 16, 18 on the channel side of the stud 10, 10' is substantially 270°. On the opposite side, the angle is substantially 90°. Both of these angles can vary. FIG. 13 shows an angle a between the two web parts on the channel side of the stud 11 that is substantially 270°. FIG. 14 shows an angle between the two web parts that is substantially 150°. FIG. 15 shows these studs 11, 13 being used at the inside and outside corners of a diagonal corner. With these studs S, there is a greater need to restrain the studs while the wall is being constructed. This can be done by use of the screws 72 shown by FIGS. 16-18. Or conventional self-tapping screws S may be used and sheet metal members 90 can be used on the inside of the web parts so that the threads of the screws S can connect to these members 90. The screws S are only loosely connected to the members 90 so that the stud webs and channel flanges are not clamped between the screw heads and the members. The connection of the screw threads to these members takes the place of the end thread 84 on the screw 72.

The illustrated embodiments are only examples of the present invention and, therefore, are non-limitive. It is to be understood that many changes in the particular structure, material and features of the invention may be made without departing from the spirit and scope of the invention. Therefore, it is our intention that our patent rights not be limited by the particular embodiments that are illustrated and described herein, but rather are to be determined by the following claims, interpreted according to accepted doctrines of patent claim interpretation, including use of the Doctrine of Equivalents.

What is claimed is:

1. A framing wall, comprising:

a first channel member having a web and spaced apart first and second flanges projecting from the web and together with the web forming a first channel space;

a second channel member having a web and spaced apart first and second flanges projecting from said web and together with the web forming a second channel space;

said second channel member extending perpendicular to the first channel member and having an end that substantially abuts the first flange of the first channel member;

a first elongated stud having a web and first and second flanges connected to the web, said web being bent along a longitudinal bend line into first and second web parts which are substantially perpendicular to each other, said first flange extends perpendicularly from the first part of the web and said second flange extends perpendicularly from the second part of the web;

said first elongated stud having a first end and a longitudinal slot extending inwardly from the first end along the longitudinal bend line;

wherein the first flange of the first channel member is positioned in said longitudinal slot, the first web part and the first flange of the stud are positioned in the first channel space and the second web part and the second flange of the stud are positioned in the second channel space; and wherein the first web part of the stud is inwardly contiguous the first flange of the first channel member, and the second web part of the stud is inwardly contiguous the first flange of the second channel member.

2. The framing wall of claim 1, comprising a lip on the first flange of the stud extending perpendicular from the first flange, and a lip on the second flange of the stud extending perpendicular to the second flange.

3. The framing wall of claim 1, further comprising an elongated second stud having a web and first and second flanges, said second stud web being bent on a longitudinal bend line into first and second web parts which are substantially perpendicular to each other, said first flange projecting perpendicular from the first web part of the stud and said second flange extending perpendicular from the second web part of the stud;

said second stud having a first end and a longitudinal slot extending inwardly from the first end along the bend line;

wherein the first flange of the first channel is positioned in the longitudinal slot of the second stud, first web part and the first flange of the second stud are positioned in the second channel space and the second web part and the second flange of the second stud are positioned in the first channel space; and wherein the first web part of the second stud is inwardly contiguous the second flange of the second channel member and the second web part of the second stud is inwardly contiguous the first flange of the first channel member.

4. The framing wall of claim 3, comprising a lip on the first flange of the second stud extending perpendicular from the first flange, and a lip on the second flange of the second stud extending perpendicular to the second flange.

5. The framing wall of claim 1, wherein the first flange of the stud extends only part way across the first channel space and the second flange of the first stud extends only part way across the second channel space.

6. The framing wall of claim 3, wherein the first flange of the second stud extends only part way across the second channel space and the second flange of the second stud extends only part way across the first channel space.

7. A stud for use with a downwardly facing first channel member having a web and first and second flanges extending downwardly from the web, and a lower channel member having a web and a pair of flanges extending upwardly from the web in substantially co-planar parallelism with the flanges of the upper channel member, said stud, comprising:

first and second ends;

a web and first and second flanges extending the full length of the stud from the first end to the second end, said web being bent about a longitudinal bend line into first and second web parts that are substantially perpendicular to each;

first flange extending substantially perpendicular from the first web part and second flange extending substantially perpendicular from the second web part; and said web including a longitudinal slot extending inwardly from the first end along the bend line, said slot being sized to receive the first flange of the upper channel member, allowing the first web part in the first flange to be positioned inside of the upper channel member and the second web part and the second flange positioned outside of the upper channel member.

8. An elongated corner stud, comprising:

upper and lower ends;

a web having opposite side edges;

first and second sidewalls connected to the opposite side edges, said sidewalls extending away from the web on the same side of the web;

said web and sidewalls forming a channel having an inner side and an outer side;

said web being bent along a longitudinal line, dividing the web into two side parts separated by an angle of substantially ninety degrees (90°); and a center slot at one end of the stud, where the web is bent, said center slot being sized to receive a track sidewall, whereby one part of the web and the sidewall connected to it can be placed in the track and the other side of the web and sidewall connected to it can be positioned outside of the track.

9. An elongated intersection stud, comprising:

upper and lower ends;

a web having opposite side edges;

first and second flanges connected to the opposite side edges, said flanges extending away from the web on the same side of the web;

said web and flanges forming a channel having an inner side and an outer side;

said web being bent along a longitudinal line, dividing the web into two side parts separated by an angle between about ninety degrees (90°) and about two hundred and seventy degrees (270°); and a slot in at least one side part of the web, said slot being elongated in the length direction of the stud at one end of the stud, where the web is bent, said slot being sized to receive a track sidewall, whereby one part of the web and the sidewall connected to it can be placed in the track and the other side of the web and the sidewall connected to it can be positioned outside of the track.

10. The stud of claim 9, comprising a said slot in both side parts of the web.

* * * * *